United States Patent [19]

Roth

[11] 4,348,876

[45] Sep. 14, 1982

[54] WEFT THREAD LAYING APPARATUS

[75] Inventor: Josef Roth, Seligenstadt, Fed. Rep. of Germany

[73] Assignee: Karl Mayer Textilmaschinen fabrik GmbH, Fed. Rep. of Germany

[21] Appl. No.: 190,579

[22] Filed: Sep. 25, 1980

[30] Foreign Application Priority Data

Sep. 26, 1979 [DE] Fed. Rep. of Germany ..... 2938860

[51] Int. Cl.[3] ..... D04B 23/06; D04B 23/08; D04B 23/10; D04B 23/12

[52] U.S. Cl. ..... 66/84 A; 66/85 A

[58] Field of Search ..... 66/85 A, 84 A, 125 R

[56] References Cited

U.S. PATENT DOCUMENTS 3,653,105 4/1972 Klaeui ..... 66/85 A X 3,953,989 5/1976 Politze et al. ..... 66/84 A

*Primary Examiner*—Ronald Feldbaum

*Attorney, Agent, or Firm*—Omri M. Behr

[57] ABSTRACT

A weft thread laying apparatus for warp knitting machines includes a carriage having a plurality of thread guides disposed thereon perpendicular to a pair of endless transfer chains which carry the weft threads from a pickup area to a delivery area proximate the needed bed of the machine. The transfer chains are additionally accelerated in the pick-up area when the carriage, moving transversely to the chains, is on the outer side of the transfer chains, thereby permitting thread guides to lay thread around holding elements disposed on the transfer chains without requiring the carriage to move in more than one plane. The carriage is provided with a plurality of thread guides which have a skirt portion larger than its stem portion to insure that the threads do not become entangled when laid around the holding elements on the transfer chains.

15 Claims, 12 Drawing Figures

74
18a
18b
18c
76
98
16
96
12
18a
18b
18c 18
102
104
106
108

110
112
114
116
118

120
122
124
126
128

130
132
134
136
138

WEFT THREAD LAYING APPARATUS

BACKGROUND OF THE INVENTION

1. Field of the Invention

The present invention relates to weft thread inserting apparatuses, and in particular to a weft thread apparatus for a warp knitting machine which moves transverse to the transfer chains and permits the warp knitting machine to operate at accelerated speeds.

2. Discussion of the Relevant Art

Weft inserting mechanisms for use with warp knitting machines are known in the art. One type, for example, is disclosed in U.S. Pat. No. 3,756,043 issued to H. Kemter on Sept. 4, 1973. The apparatus disclosed therein includes a carriage having a plurality of thread guides therein, which move transverse to a pair of parallel endless chains which rotate continuously in the same direction and the same speed and have affixed thereon a plurality of retaining elements in the form of hooks extending upwardly. The weft yarn layer or carriage moves transversely to the endless chains and when it moves toward the outer portion thereof it transfers a plurality of weft threads in a continuous fashion to an intermediate or holding bar which is provided with a plurality of hooks adapted to receive the weft threads. When the carriage moves away from the holding bar, the bar is caused to move into position where it may transfer the threads onto the holding elements provided on the transfer chains. This apparatus requires an intermediate step and slows down the operation of the warp knitting machine.

In U.S. Pat. No. 3,665,732, issued to Wolfgang Doring et al. on May 30, 1972, there is disclosed a weft laying apparatus which eliminates the intermediate holding step. However, the apparatus disclosed therein requires that the carriage in addition to moving transverse to the parallel transfer chains must be provided with a rocking motion in order that the thread laying element may lay the weft threads about the holding elements provided on the endless transfer chains. The apparatus, by requiring an additional plane of movement for the carriage supplying the weft threads, limits the maximum speed of operation of the warp knitting machine.

An earlier U.S. Pat. No. 1,680,614, issued to E. H. Hill et al. on Aug. 14, 1928, discloses a weft inserting apparatus for use on warp knitting machines which again limits the speed of operation of the warp knitting machine since it requires two motions for the carriage that supplies the weft threads.

The instant invention overcomes the shortcomings of known devices by operating the weft laying carriage in one plane of operation and obtaining the warp-around or laying of the weft threads on the endless transfer chain holding element by causing the transfer chain to additionally and incrementally increase its speed periodically as the weft threads are fed to the holding elements of the transfer chains thereby permitting the carriage to move in only one plane and accomplishing the wrap-around or laying motion around the chain holding elements with accuracy and permitting the warp knitting machine to operate at higher speeds.

The weft inserting apparatus according to the two last mentioned U.S. patents have the further disadvantage that the threads become entangled when laid around the holding elements on the transfer chains. According to the invention skirt means on each thread guide could be used to assure that each thread does not interfere with the guiding of the other threads. This allows higher operation speeds, too.

SUMMARY OF THE INVENTION

Therefore, it is an object of the present invention to provide a weft thread laying apparatus for warp knitting machines which does not markedly alter the maximum speed of operation of the machine.

It is another object of the present invention to provide a weft thread laying apparatus for warp knitting machines that can reliably feed the weft thread to holding elements provided on the transfer chain.

It is yet another object of the present invention to provide a weft thread laying apparatus for warp knitting machines that requires a reduced number of operating mechanisms to increase the reliability of the machine.

A further object of the present invention is to provide a weft thread laying apparatus for wrap knitting machines that reliably feeds the weft threads onto holding elements of the transfer chains without causing entanglement of the threads as they are laid about the holding elements on the transfer chain.

The foregoing and other objects and advantages will appear from the description to follow. In the description reference is made to the accompanying drawing which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the scope of the invention.

The foregoing detailed description is, therefore, not to be taken in a limiting sense and the scope of the invention is best defined by the appended claims.

A weft thread laying apparatus for warp knitting machines, according to the principles of the present invention, comprises, in combination, a pair of endless transfer chains generally disposed perpendicular to the needle bed of the warp knitting machine and proximate the ends thereof for continually carrying weft threads from a pick-up area to a delivery area proximate the needle bed. The transfer chains are provided with a plurality of holding elements disposed thereon. A carriage is disposed above the pair of transfer chains in the pick-up area and is movable back and forth perpendicular to the transfer chains. A plurality of thread guides are disposed upon the carriage for laying a plurality of weft threads about the holding elements disposed on one of the transfer chains and then about the holding elements on the other of the transfer chains in a continuing sequence. A mechanism for periodically additionally moving each of the transfer chains relative to the thread guides when the carriage is proximate each transfer chain is provided, thus permitting the weft threads to lay around the holding elements on each transfer chain.

Independent of the mode of relative movement in the direction of the transfer chains—whether the transfer chains are additionally moved relative to the thread guides or the carriage is moved relative to the transfer chains or both relative movements are combined—each thread guide means could be provided with a skirt extending beyond the exit point of the warp thread from the thread guide means.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
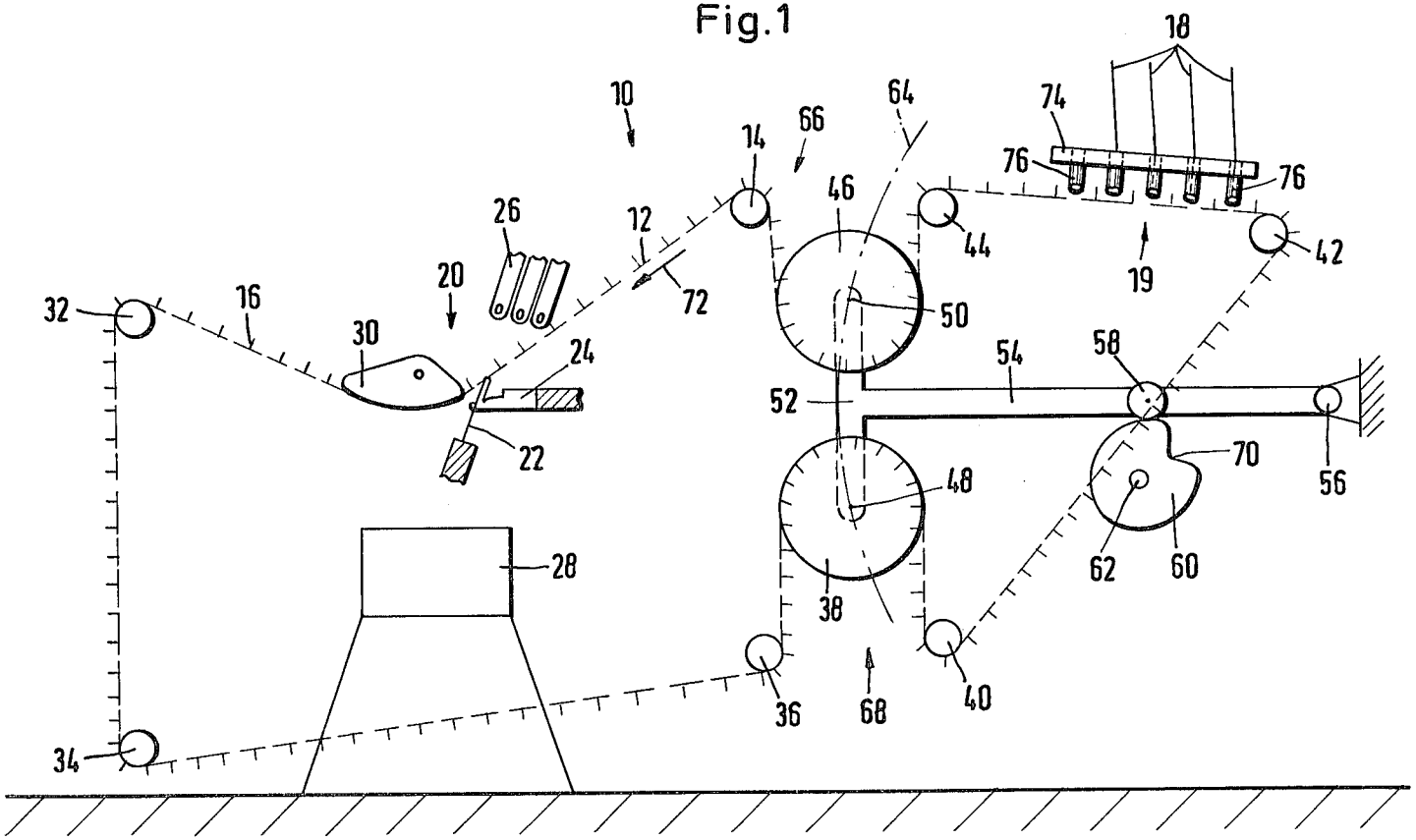
FIG. 1 is a schematic side view in elevation of a weft thread laying apparatus, in accordance with the principles of the present invention, having a transfer chain and appropriate driving means.

Referring now to the figures, and in particular to FIG. 1, there is disclosed a weft thread laying apparatus 10 which includes an endless transfer chain 12 that is driven by a first sprocket gear 14 operatively coupled to the source of driving power of the warp knitting machine, not shown. The transfer chain 12 is provided with a plurality of holdingelements 16 that are adapted to receive and retain the weft threads thereon as will be explained hereinafter. Preferably the holding elements 16 are equally spaced along the transfer chain and permanently affixed thereon. The weft threads 18 are supplied to the holding elements 16 at a pick-up area 19 and carry them to a delivery area 20 proximate the needles 22, knockover sinkers 24, and guides 26 of the warp knitting machine 28, which is of conventional design.

The transfer chain 12 is an endless chain and it runs over a first sprocket gear 14. It is positioned by a movable guide bar 30 and then passes around a second drive sprocket gear 32 and an additional turning sprocket gear 34, a third driven sprocket gear 36, a speed control guide sprocket wheel 38, a further sprocket gear 40, yet further turning sprocket gears 42 and 44 and another speed control guide sprocket gear 46 to the first driven sprocket gear 14.

The axis 48 of speed control guide sprocket wheel 38 and the axis 50 of speed control guide sprocket wheel 46 are affixed to a cross-bar 52 of lever 54. Lever 54 is swingable about a fixed axis 56 and is provided with a roller 58 which is journaled upon lever 54 and cooperates with heart-shaped cam 60 affixed on shaft 62 for continuous rotation and is operatively coupled to the source of driving power of the warp knitting machine 28. Because of the shape of the cam 60 and its coacting with roller 58, lever 54 causes the axis 50 and 48 of speed control wheels 38 and 46 to move in an arcuate path 64. The sprocket gears 14 and 44 together with speed control wheels 46 form a first speed control arrangement 66 and sprocket gears 36 and 40 together with speed control wheel 38 form a second speed control arrangement 68. Movement of speed control wheel 46 in a downwardly direction caused by the depression 70 provided in cam 60 will cause the endless transfer chain 12 to be suddenly advanced or moved forward in the direction of arrow 72 which is the normal direction of movement of the transfer chain 12.

A carriage 74, shown schematically carries the thread guides 76 for delivery of the weft threads 18 to the holding elements 16.

Figure 2:
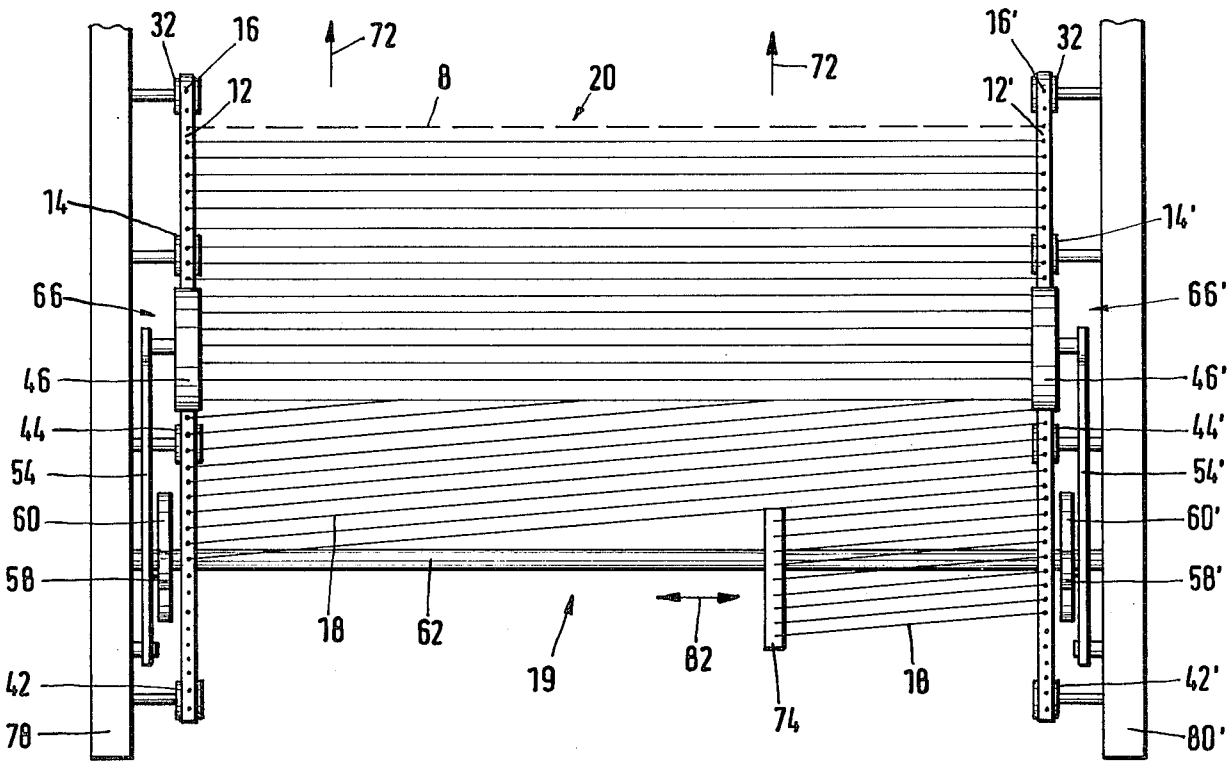
FIG. 2 is a plan view of the apparatus shown in FIG. 1.

Although only one endless transfer chain 12 is represented in FIG. 1, it is to be clearly understood that a second duplicate transfer chain is provided on the other end of the warp knitting machine with the carriage 74 moving transversely thereto as is more clearly shown in FIG. 2.

By means of the upward and downward movement of lever 54 the speed of the transfer chain 12 may be periodically altered with respect to the carriage 74. For example, FIG. 1 illustrates the situation wherein the thread guides 76 move between the holding elements 16 on a momentarily stationary transfer chain 12.

Referring now to FIG. 2, which is a plan view of the warp knitting machine in the area of the weft thread laying apparatus that is disposed between the two housing walls 78 and 80 of the warp knitting machine frame 28. The left side of the machine is provided with identical parts to the right side but for convenience they have been given prime numbers. The carriage 74 is moved transverse to the movement of the endless transfer chains 12 and 12′ in the direction of arrow 82 and then back again.

Figure 3:
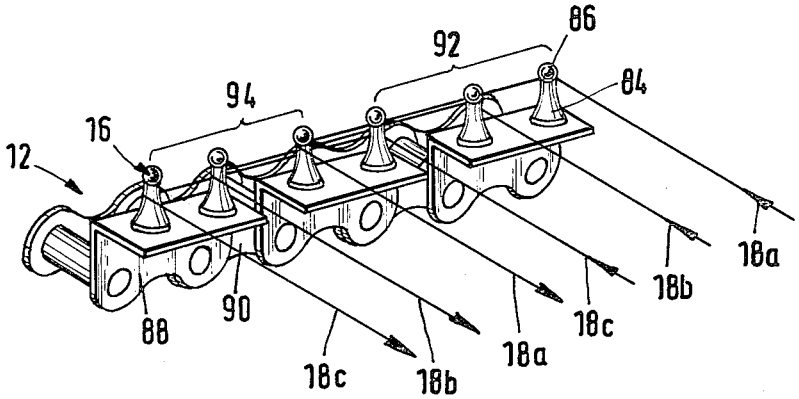
FIG. 3 is an enlarged pictorial representation of a section of a transfer chain shown in a downwardly directed view.

Referring now to FIG. 3 which is a pictorial representation of a portion of the transfer chain 12 having holding elements 16 provided thereon. Preferably the lower portion 84 of holding element 16 is in the shape of a truncated cone and the upper portion 86 is spherically shaped forming the general shape of a pawn used in the playing of chess. Preferably two holding elements 16 are affixed to each chain link 88 which are connected to each other by movable connecting members 90. Using an example of three weft threads 18*a*, 18*b*, and 18*c*, it is shown how these are laid about a first group 92 of holding elements 16 and then brought back and laid over a second sidewardly displaced group 94 of holding elements 16.

Figure 4:
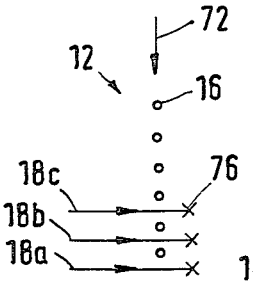
FIGS. 4 through 7 show different positions of the transfer chain relative to the carriage when the carriage is positioned on the outer side of the transfer chain.
Figure 5:
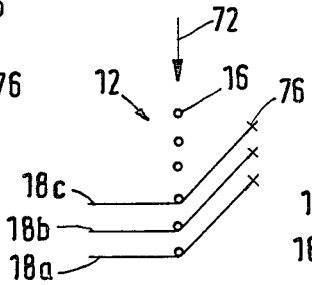
Figure 6:
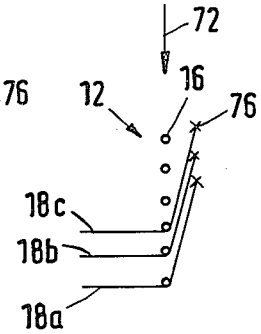
Figure 7:
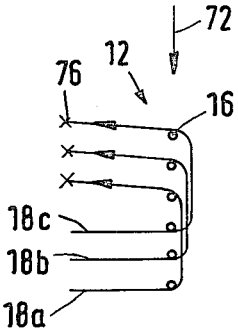

Referring now to FIGS. 4 through 7 which disclose a schematic representation of the transfer chain 12 with a plurality of holding elements 16 thereon in the pick-up location 19 with the transfer chain moving in the direction as shown by arrow 72. As shown in FIG. 4, the weft threads 18*a*, 18*b*, and 18*c* are led through holding elements 16 by thread guides 76 onto the far side (outer) of transfer chain 12 during which time the transfer chain 12 is either stationary or moving very slowly. FIG. 5 discloses the thread guides 76 at the point at which the carriage, including the thread guides are about to return. The transfer chain 12 moves with greater speed at this point in time in the direction of arrow 72. As shown in FIG. 6, the thread guides effectively move in the opposite direction. As shown in FIG. 6, the thread guides 76 start moving in the return direction while the transfer chain 12 is moving very slowly or is stationary so that the weft threads may pass unhindered through the displaced holding elements 16. In FIG. 7 the thread guides are returning, moving in the direction of the opposite transfer chain as shown in FIG. 2 by the left-hand portion of arrow 82, while the transfer chain 12 continues moving in the direction of arrow 72. The weft thread is permitted to lay around the holding elements in this manner without the carriage being caused to be given any additional movement. Thus, with this combined movement, the weft threads remain in the same position as dispensed from the thread guides 76.

Figures 8, 9, 10, 11, 12:
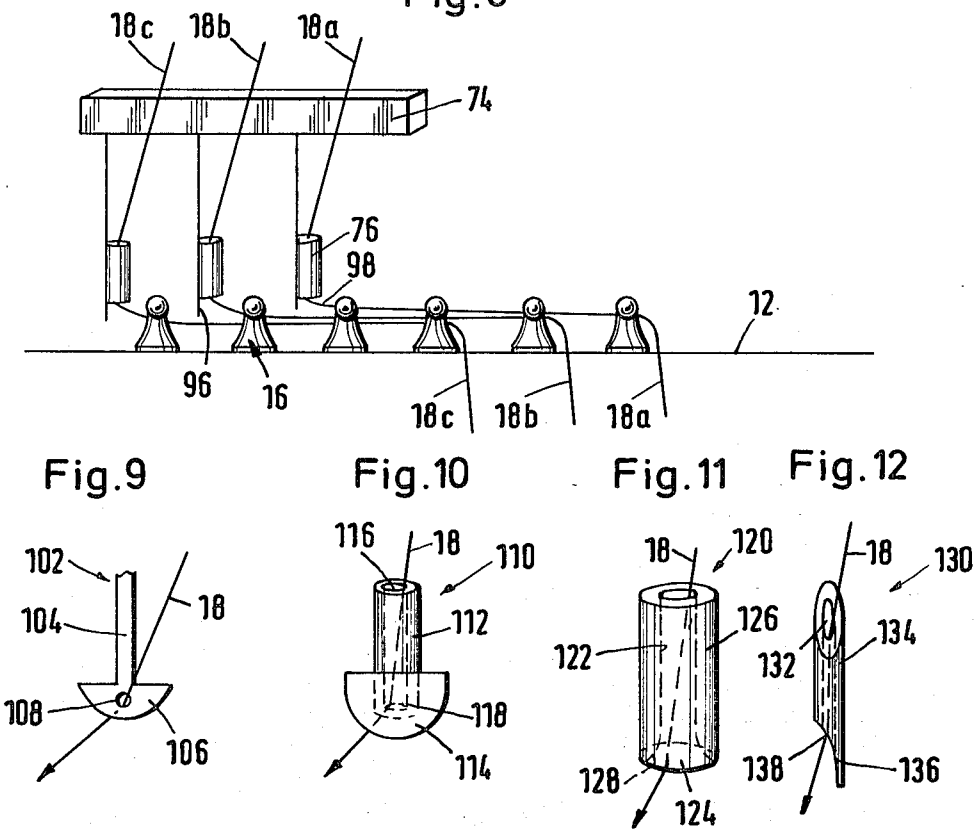
FIG. 8 is an enlarged pictorial representation of the carriage and associated thread guides during the thread laying stage.
FIGS. 9 through 12 show different forms of the thread guide with its associated skirt.

Referring now to FIG. 8 which shows a tubular formed thread guide 76 affixed on a carriage 74 in a position which generally corresponds to that shown in FIG. 6. The thread guides 76 have downwardly directed skirts 96 which assures that the weft thread 18*b* does not interfere with the guiding of weft thread 18*a* in the area of the thread feed 98. Thus, when the thread guide 76, as shown in FIG. 7, is led through the space between holding elements 16 the threads 18 may be freely laid about the appropriate holding elements.

FIG. 9 discloses a thread guide 102 that includes a stem portion 104 and a skirt portion 106. In the embodiment disclosed in FIG. 9, the thread guide is fabricated of a stamped tin plate that is provided with ahole 108 which is utilized as the feed point with the thread 18. The thread skirt 106 not only protrudes downwardly below the thread feeding hole 108 but also is substantially wider than the thread guide stem 104.

FIG. 10 discloses an alternate embodiment 110 of a thread guide which is preferably tubular shaped having a stem portion 112 and a skirt portion 114. Here again, the skirt portion 114 is greater in width than the stem portion 112. The thread 18 is fed through the center aperture 116 provided in the stem portion 112 and exits from the thread feed point 118. The skirt portion 114 extends below the thread feed point 118 so that the adjoining thread will be guided away from a thread moving through the aperture 116 thereby preventing any knotting or interruption in smooth thread movement.

Yet another embodiment of a thread guide 120 is shown in FIG. 11. The thread guide 120 is tubular shaped and provided with an aperture 122 which extends outwardly at the thread feed point 124 so that the stem portion 126 and skirt portion are one in the same with the effective increased width at the thread feed point being accomplished by the outwardly extending portion 128 of aperture 122.

FIG. 12 discloses yet another embodiment 130, the embodiment of a thread guide having a similar construction, being generally tubular shaped, having an aperture 132 provided therein through which the thread 18 may pass. With the construction disclosed herein the stem portion 134 and the skirt portion 136 are the same width. However, the skirt portion 136 extends beyond the thread feed point 138 effectively providing a directing path for the weft thread so that it does not become entangled with the thread passing along side.

Hereinbefore has been disclosed a weft thread laying apparatus which overcomes shortcomings found in the prior art and permits the warp knitting machine to operate at higher speeds than earlier devices since the carriage and thread guide only moves in one plane transverse to the transfer chains. It will be understood that various changes in the materials, the arrangement of parts, and operating conditions which have been herein described and illustrated in order to explain the nature of the invention may be made by those skilled in the art within the principles and scope of the present invention.

Having thus set forth the nature of the invention what is claimed is:

1. A weft thread laying apparatus for warp knitting (a) a pair of endless transfer chain means generally disposed perpendicular to the needle bed of said warp knitting machine and proximate the ends thereof for continually carrying weft threads from a pick-up area to a delivery area proximate said needle bed, said transfer chains being provided with a plurality of holding elements disposed thereon;

(b) carriage means disposed above said pair of transfer chain means in said pick-up area, movable back and forth perpendicular to said transfer chain means;

(c) a plurality of thread guide means disposed upon said carriage means for laying a plurality of weft threads about said holding elements disposed on one of said pair of transfer chain means and then about the holding elements disposed on the other of said pair of transfer chain means in a continuing sequence; and (d) means for periodically additionally moving each said transfer chain means relative to said thread guide means when said carriage means is proximate each said transfer chain means for permitting said weft threads to lay around said holding elements on said transfer chain means.

2. A weft thread laying apparatus for warp knitting machines according to claim 1 wherein said transfer chain means are additionally moved when said carriage means is beyond the area defined by said transfer chain means.

3. A weft thread laying apparatus for warp knitting machines according to claim 1 wherein each said thread guide means is provided with a skirt extending beyond the exit point of said warp thread from said thread guide means.

4. A weft thread laying apparatus for warp knitting machines according to claim 3 wherein said thread guide means skirt is rounded.

5. A weft thread laying apparatus for wrap knitting machines according to claim 1 wherein each said thread guide means is provided with a stem portion and a skirt portion, said skirt portion being wider than said stem portion.

6. A weft thread laying apparatus for warp knitting machines according to claim 1 wherein each said thread guide means is a hollow cylinder having a stem portion and a skirt portion, said skirt portion having an opening extending outwardly in the direction of thread feed and communicating with the opening in said stem portion.

7. A weft thread laying apparatus for warp knitting machines according to claim 1 wherein said transfer chain means holding elements are equally spaced along said transfer chain means.

8. A weft thread laying apparatus for warp knitting machines according to claim 1 wherein said holding elements are sufficiently spaced apart to permit said thread guide means to pass therebetween.

9. A weft thread laying apparatus for warp knitting machines according to claim 1 wherein said holding elements are shaped in the form of a truncated cone with a sphere affixed thereon.

10. A weft thread laying apparatus for warp knitting machines according to claim 8 wherein said transfer chain means holding elements are pawn-like in shape.

11. A weft thread laying apparatus for warp knitting machines according to claim 1 wherein each said transfer chain moving means increases the speed of said transfer chain means in said pick-up area when said carriage means and thread guide means are on the outer side of each transfer chain means.

12. A weft thread laying apparatus for warp knitting machines comprising (a) a pair of endless transfer chain means generally disposed perpendicular to the needle bed of said warp knitting machine and proximate the ends thereof for continually carrying weft threads from a pick-up area to a delivery area proximate said needle bed, said transfer chains being provided with a plurality of holding elements disposed thereon;

(b) carriage means disposed above said pair of transfer chain means in said pick-up area, movable back and forth perpendicular to said transfer chain means;

(c) a plurality of thread guide means disposed upon said carriage means for laying a plurality of weft threads about said holding elements disposed on one of said pair of transfer chain means and then about the holding elements disposed on the other of said pair of transfer chain means in a continuing sequence;

(d) means for periodically moving each said transfer chain means and said thread guide means relative to each other when said carriage means is proximate each said transfer chain means for permitting said weft threads to lay around said holding elements on said transfer chain means;

(e) each said thread guide means being provided with a skirt extending beyond the exit point of said warp thread from said thread guide means.

13. A weft thread laying apparatus for warp knitting machines according to claim 12 wherein said thread guide means skirt is rounded.

14. A weft thread laying apparatus for warp knitting machines according to claim 12 wherein each said thread guide means is provided with a stem portion and said skirt portion, said skirt portion being wider than said stem portion.

15. A weft thread laying apparatus for warp knitting machines according to claim 12 wherein each said thread guide means is a hollow cylinder having a stem portion and said skirt portion, said skirt portion having an opening extending outwardly in the direction of thread feed and communicating with the opening in said stem portion.

* * * * *